US010524341B2

(12) United States Patent
Miller et al.

(10) Patent No.: US 10,524,341 B2
(45) Date of Patent: Dec. 31, 2019

(54) FLOWING-FLUID X-RAY INDUCED IONIC ELECTROSTATIC DISSIPATION

(71) Applicant: Moxtek, Inc., Orem, UT (US)

(72) Inventors: Eric Miller, Provo, UT (US); Steven West Wilson, Farmington, UT (US)

(73) Assignee: Moxtek, Inc., Orem, UT (US)

( * ) Notice: Subject to any disclaimer, the term of this patent is extended or adjusted under 35 U.S.C. 154(b) by 460 days.

(21) Appl. No.: 15/407,751

(22) Filed: Jan. 17, 2017

(65) Prior Publication Data

US 2017/0127504 A1 May 4, 2017

Related U.S. Application Data

(63) Continuation-in-part of application No. 15/065,440, filed on Mar. 9, 2016, now Pat. No. 9,839,107.

(60) Provisional application No. 62/159,092, filed on May 8, 2015.

(51) Int. Cl.

| | |
|---|---|
| ***H05F 3/00*** | (2006.01) |
| ***H05F 3/06*** | (2006.01) |
| ***H05F 3/04*** | (2006.01) |
| ***H01J 9/24*** | (2006.01) |

(52) U.S. Cl.

CPC ..... *H05F 3/06* (2013.01); *H01J 9/241* (2013.01); *H05F 3/04* (2013.01)

(58) Field of Classification Search

CPC ..... H05F 3/06

See application file for complete search history.

(56) References Cited

U.S. PATENT DOCUMENTS

| | | | | |
|---|---|---|---|---|
| 3,970,884 | A | 7/1976 | Golden | |
| 4,119,234 | A | 10/1978 | Kotschak et al. | |
| 5,469,490 | A | 11/1995 | Golden et al. | |
| 5,651,045 | A | 7/1997 | Pouvesle et al. | |
| 5,750,011 | A * | 5/1998 | Ohmi | H05F 3/06 204/164 |
| 6,205,200 | B1 | 3/2001 | Boyer et al. | |
| 6,353,658 | B1 | 3/2002 | Trebes et al. | |
| 6,563,110 | B1 | 5/2003 | Len | |
| 6,570,959 | B1 | 5/2003 | Kuzniar | |
| 9,240,303 | B2 | 1/2016 | Barnum et al. | |
| 2004/0008818 | A1 | 1/2004 | Rangsten et al. | |

(Continued)

FOREIGN PATENT DOCUMENTS

| | | |
|---|---|---|
| CN | 1835653 A | 9/2006 |
| CN | 101021626 A | 8/2007 |

(Continued)

*Primary Examiner* — Dani Fox

(74) *Attorney, Agent, or Firm* — Thorpe, North & Western, LLP

(57) ABSTRACT

An electrostatic dissipation device 10 can comprise an elongated enclosure 11 with a longitudinal axis 12. An x-ray source 13 can be oriented to emit x-rays 16 inside of and along the longitudinal axis 12. A fluid-flow device 14 can be oriented to cause fluid to flow across the x-ray source 13 then inside of and along the longitudinal axis 12, the fluid being ionized by the x-rays 16, forming ionized fluid, then out of the elongated enclosure through outlet opening(s) 15. The arrangement of the x-ray source 13 and the fluid-flow device 14 can allow (1) fluid from the fluid-flow device 14 to cool the x-ray source 13, and (2) ion generation along the length of the elongated enclosure 11.

20 Claims, 4 Drawing Sheets

(56) References Cited

U.S. PATENT DOCUMENTS

| | | | | |
|---|---|---|---|---|
| 2005/0031083 | A1 | 2/2005 | Kindlein | |
| 2007/0076849 | A1* | 4/2007 | Bard | H01J 35/14 378/121 |
| 2007/0188970 | A1 | 8/2007 | Inaba et al. | |
| 2008/0110397 | A1 | 5/2008 | Hyoung | |
| 2008/0278880 | A1* | 11/2008 | Kisakibaru | G02F 1/1303 361/213 |
| 2010/0074410 | A1 | 3/2010 | Ito et al. | |
| 2013/0308756 | A1 | 11/2013 | Bogan et al. | |
| 2015/0092924 | A1 | 4/2015 | Yun et al. | |

FOREIGN PATENT DOCUMENTS

| | | | |
|---|---|---|---|
| CN | 101178502 | A | 5/2008 |
| CN | 101299899 | A | 11/2008 |
| CN | 102254764 | A | 11/2011 |
| JP | 2000/267106 | A | 9/2000 |
| JP | 2002/352997 | A | 12/2002 |
| JP | 2002353096 | A | 12/2002 |
| JP | 2004299814 | A | 10/2004 |
| JP | 2006/049390 | A | 2/2006 |
| JP | 2014/514718 | A | 6/2014 |
| JP | 2014/143168 | A | 8/2014 |
| KR | 10-2004-0095587 | A | 11/2004 |
| KR | 10-2007-0071298 | A | 7/2007 |
| KR | 10-2013-0018540 | A | 2/2013 |

* cited by examiner

FLOWING-FLUID X-RAY INDUCED IONIC ELECTROSTATIC DISSIPATION

CLAIM OF PRIORITY

This application is a continuation-in-part of U.S. patent application Ser. No. 15/065,440, filed on Mar. 9, 2016, which claims priority to U.S. Provisional Patent Application Ser. No. 62/159,092, filed on May 8, 2015, which are hereby incorporated herein by reference in their entirety.

FIELD OF THE INVENTION

The present application is related generally to x-ray sources for electrostatic dissipation.

BACKGROUND

Static electric charges on various materials, such as electronic components, can discharge suddenly, resulting in damage. It can be beneficial to provide a conductive path with proper resistance level for a gradual dissipation of such charges without damage to the materials.

SUMMARY

It has been recognized that it would be advantageous to reduce static electric charges without damage to sensitive materials. The present invention is directed to various embodiments of an electrostatic dissipation device that satisfy this need.

The electrostatic dissipation device can comprise an elongated enclosure with a longitudinal axis and an x-ray source oriented to emit x-rays inside of and along the longitudinal axis. A fluid-flow device can be oriented to cause fluid to flow (i) across the x-ray source, then (ii) inside of and along the longitudinal axis, the fluid being ionized by the x-rays, forming ionized fluid, then (iii) out of the elongated enclosure through outlet opening(s).

BRIEF DESCRIPTION OF THE DRAWINGS (DRAWINGS MIGHT NOT BE DRAWN TO SCALE)

Figure 1:
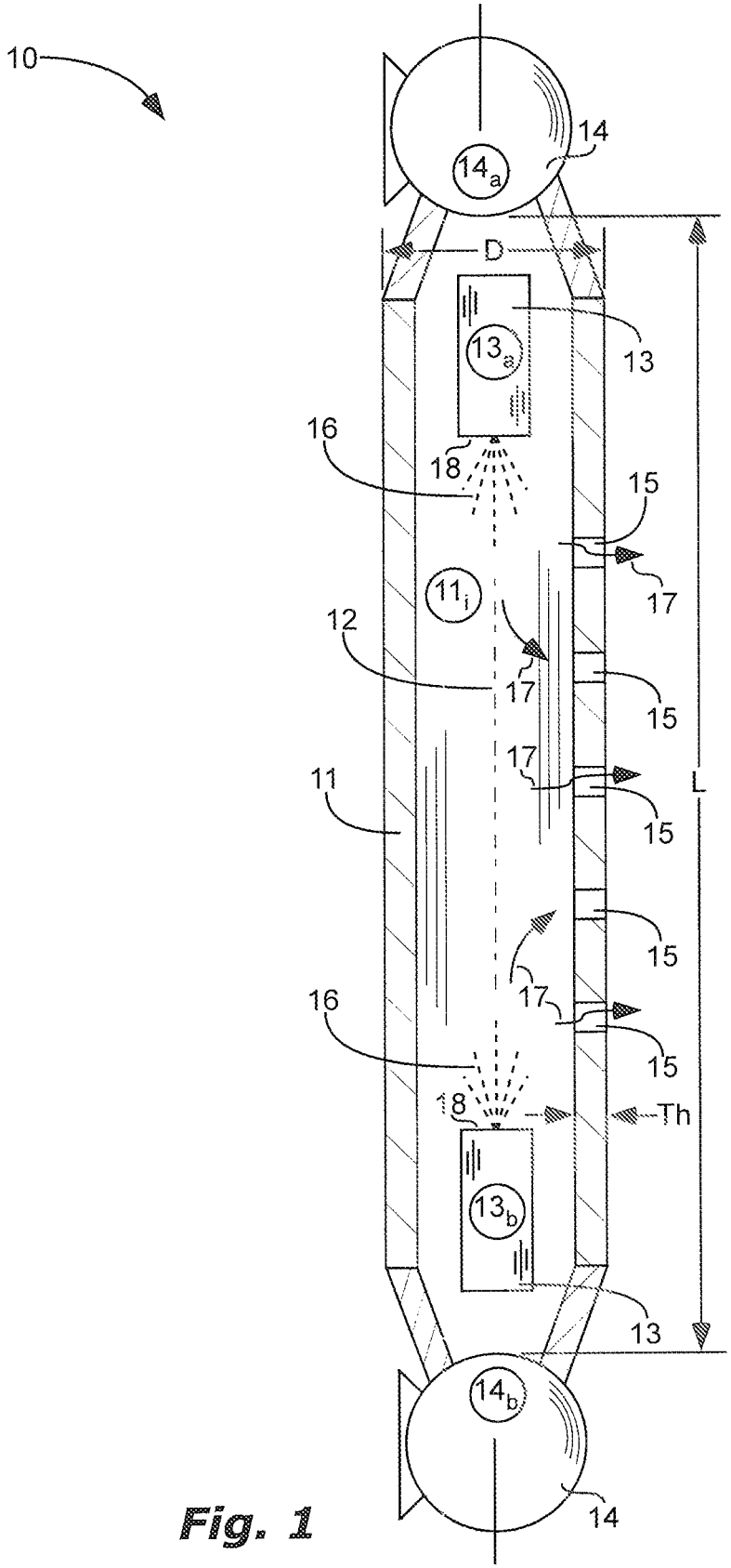

FIG. 1 is a schematic, cross-sectional side-view of an electrostatic dissipation device 10 with an elongated enclosure 11 having a longitudinal axis 12; a first x-ray source $\mathbf{13}_a$ and a second x-ray source $\mathbf{13}_b$ facing each other and oriented to emit x-rays 16, in opposite directions, inside of and along the longitudinal axis 12; a first fluid-flow device $\mathbf{14}_a$ and a second fluid-flow device $\mathbf{14}_b$ oriented to cause fluid to flow across the x-ray sources $\mathbf{13}_a$ and $\mathbf{13}_b$ then inside of and along the longitudinal axis 12, in opposite directions, the fluid being ionized by the x-rays 16, forming ionized fluid 17, then out of the elongated enclosure 11 through outlet opening(s) 15, in accordance with an embodiment of the present invention.

Figure 2A:
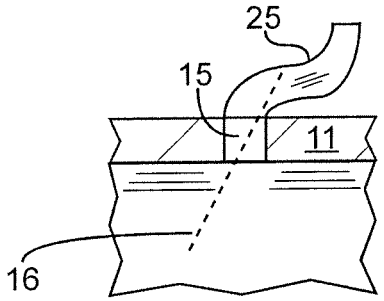

FIG. 2*a* is a schematic, cross-sectional side-view of a portion of the elongated enclosure 11, an outlet opening 15, and a nozzle 25 at the outlet opening 15, the nozzle 25 including a curved profile so there is no straight-line path from any location inside of the elongated enclosure 11, through an open channel inside the nozzle 25, to outside the elongated enclosure 11, in accordance with an embodiment of the present invention.

Figure 2B:
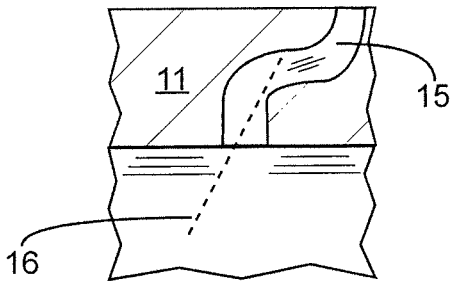

FIG. 2*b* is a schematic, cross-sectional side-view of a portion of the elongated enclosure 11, and an outlet opening 15 in a wall of the elongated enclosure 11, the outlet opening 15 including a curved profile so there is no straight-line path from any location inside of the elongated enclosure 11, through an open channel inside the outlet opening 15, to outside the elongated enclosure 11, in accordance with an embodiment of the present invention.

Figure 3:
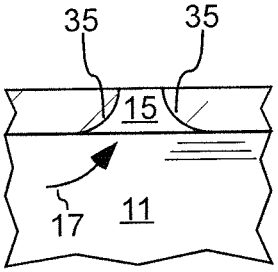

FIG. 3 is a schematic, cross-sectional side-view of a portion of the elongated enclosure 11 with an outlet opening 15 including a curved entry 35 to allow ionized fluid 17 to flow from inside the elongated enclosure 11 into the outlet opening 15 along a smooth curvature, in accordance with an embodiment of the present invention.

Figure 4:
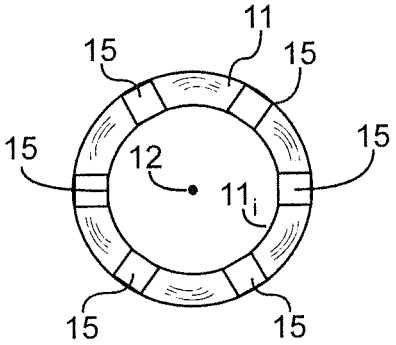

FIG. 4 is an end-view of the elongated enclosure 11 (for clarity, shown without any x-ray source 13 or fluid-flow device 14), showing a plurality of outlet openings 15 arranged in a 360 degree arc perpendicular to the longitudinal axis 12 of the elongated enclosure 11, in accordance with an embodiment of the present invention.

Figure 5:
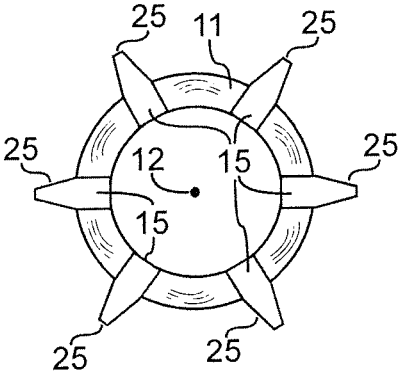

FIG. 5 is an end-view of the elongated enclosure 11, similar to the elongated enclosure 11 of FIG. 4, but further comprising a nozzle 25 at each outlet opening 15, in accordance with an embodiment of the present invention.

Figure 6:
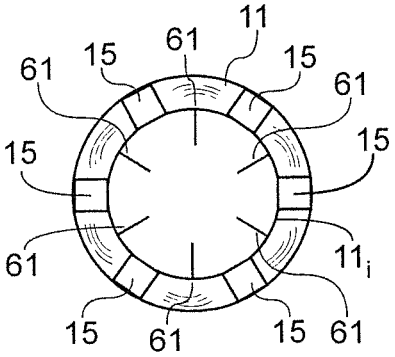

FIG. 6 is an end-view of the elongated enclosure 11 (for clarity, shown without any x-ray source 13 or fluid-flow device 14), further comprising fins 61, at an inside of the elongated enclosure 11, oriented parallel to the longitudinal axis 12 of the elongated enclosure 11, in accordance with an embodiment of the present invention.

Figure 7:
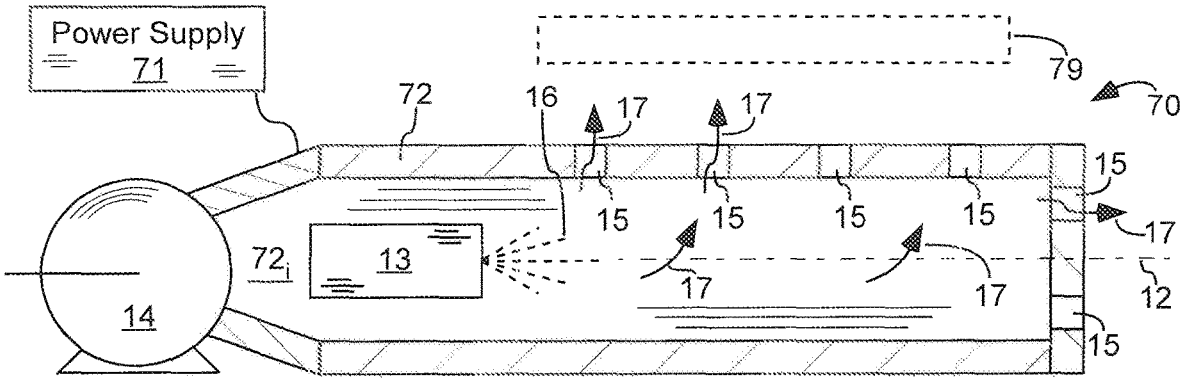
Figure 8:
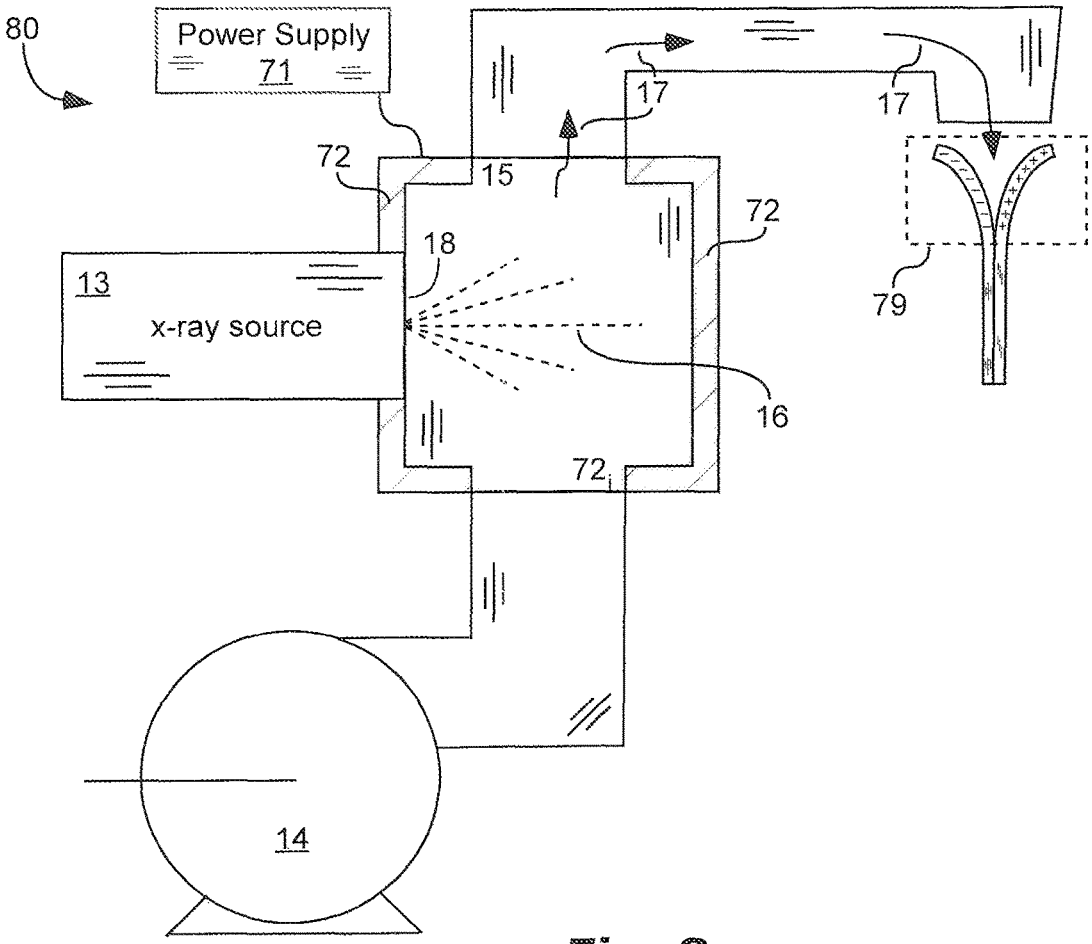

FIGS. 7-8 are schematic, cross-sectional side-views of electrostatic dissipation devices 70 and 80, each with an ionization chamber 72, an x-ray source 13 attached to the ionization chamber 72 that is capable of emitting x-rays 16 into the ionization chamber 72, and an electrical power supply 71 electrically-coupled to the ionization chamber 72, in accordance with embodiments of the present invention.

Figure 9:
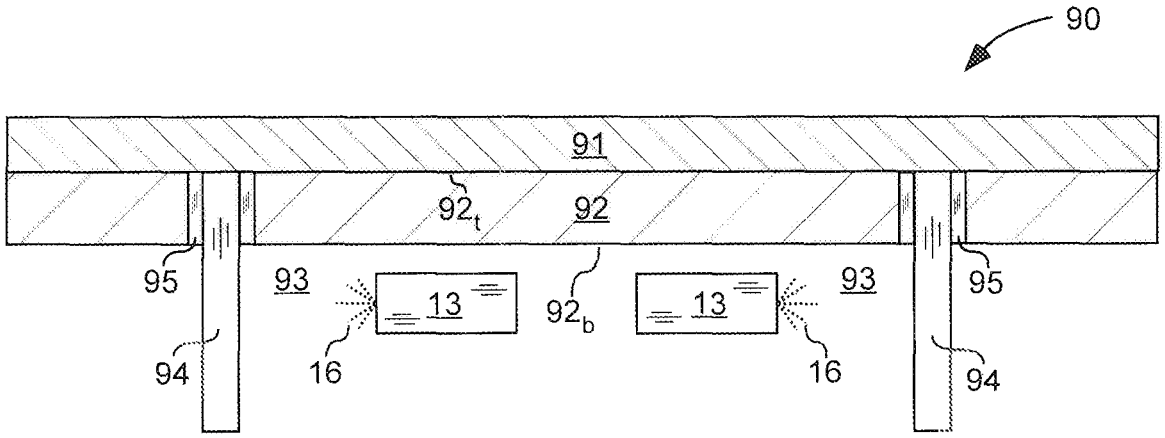
Figure 10:
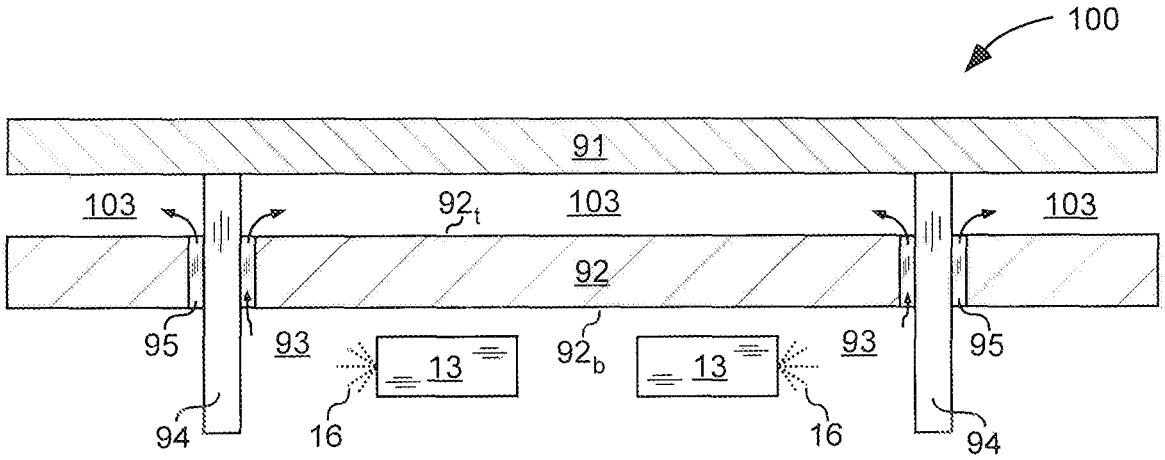

FIGS. 9-10 are schematic, cross-sectional side-views of steps in a method of electrostatic dissipation of a slab of material 91, in accordance with an embodiment of the present invention.

DEFINITIONS

As used herein, the term "electrostatic discharge" means a rapid flow of static electricity from one object to another object. Electrostatic discharge can result in damage to electronic components. In contrast, the term "electrostatic dissipation" means a relatively slower flow of electricity from one object to another object. Electrostatic dissipation usually does not result in damage to electronic components.

As used herein, the term "nozzle" means a projecting pipe or spout from which fluid is discharged.

DETAILED DESCRIPTION

As illustrated in FIG. 1, an electrostatic dissipation device 10 is shown comprising an elongated enclosure 11 with a longitudinal axis 12. An x-ray source 13 can be oriented to emit x-rays 16 inside of and along the longitudinal axis 12 of the elongated enclosure 11. A fluid-flow device 14 can be oriented to cause fluid to flow across the first x-ray source $\mathbf{13}_a$ then inside of and along the longitudinal axis 12 of the elongated enclosure 11. The fluid can be ionized by the x-rays 16, forming ionized fluid 17, which can exit out of the elongated enclosure 11 through outlet opening(s) 15.

The x-ray source 13 can be a first x-ray source $\mathbf{13}_a$ and the electrostatic dissipation device 10 can further comprise a second x-ray source $\mathbf{13}_b$ oriented to emit x-rays 16 inside of and along the longitudinal axis 12 of the elongated enclosure 11 towards the first x-ray source $\mathbf{13}_a$. The first x-ray source $\mathbf{13}_a$ can face the second x-ray source $\mathbf{13}_b$, i.e. an x-ray emission end 18 of the first x-ray source $\mathbf{13}_a$ can face an x-ray emission end 18 of the second x-ray source $\mathbf{13}_b$. The first x-ray source $\mathbf{13}_a$ and the second x-ray source $\mathbf{13}_b$ can be located at opposite ends of the longitudinal axis 12 of the elongated enclosure 11. An inside of the elongated enclosure 11 can be straight from the first x-ray source $\mathbf{13}_a$ to the second x-ray source $\mathbf{13}_b$.

The fluid-flow device 14 can be a first fluid-flow device $\mathbf{14}_a$ and the electrostatic dissipation device 10 can further comprise a second fluid-flow device $\mathbf{14}_b$ oriented to cause fluid to flow across the second x-ray source $\mathbf{13}_b$ then inside of and along the longitudinal axis 12 of the elongated enclosure 11 towards the first fluid-flow device $\mathbf{14}_a$. The fluid can be ionized by the x-rays 16, forming ionized fluid 17, which can exit out of the elongated enclosure through the outlet opening(s) 15.

The fluid can be any fluid including air, other gas, water, or other liquid. Thus, the term "fluid" can be replaced anywhere herein by "air", "gas", "water", or "liquid". The fluid-flow device(s) $\mathbf{14}_a$ and $\mathbf{14}_b$ can be any device that can cause fluid to flow across the x-ray source(s) $\mathbf{13}_a$ and/or $\mathbf{13}_b$ and inside of and along the longitudinal axis 12 of the elongated enclosure 11. For example, the fluid-flow device(s) $\mathbf{14}_a$ and $\mathbf{14}_b$ can be a fan, a pump, compressed fluid, or combinations thereof.

The x-ray source(s) $\mathbf{13}_a$ and/or $\mathbf{13}_b$ and the fluid-flow device(s) $\mathbf{14}_a$ and $\mathbf{14}_b$, respectively, can be aligned. X-ray 16 emission of the first x-ray source $\mathbf{13}_a$ and fluid flow from the first fluid-flow device $\mathbf{14}_a$ can be oriented in a common direction. X-ray 16 emission of the second x-ray source $\mathbf{13}_b$ and fluid flow from the second fluid-flow device $\mathbf{14}_b$ can be oriented in a common direction, which can be opposite of the direction of x-rays 16 from the first x-ray source $\mathbf{13}_a$ and fluid flow from the first fluid-flow device $\mathbf{14}_a$.

The outlet opening(s) 15 can be located in a sidewall of the elongated enclosure 11 between the first x-ray source $\mathbf{13}_a$ and the second x-ray source $\mathbf{13}_b$. There can be one or there can be a plurality of outlet opening(s) 15. As shown in FIG. 1, a plurality of outlet openings 15 can be arranged in a row parallel to the longitudinal axis 12 of the elongated enclosure 11.

The elongated enclosure 11 can have a length L between the fluid-flow devices $\mathbf{14}_a$ and $\mathbf{14}_b$, or if there is a single the fluid-flow device 14, from it to an opposite of the elongated enclosure 11. This length L can be larger than an outer diameter D of the elongated enclosure 11. For example, LID can be larger than two in one aspect, larger than five in another aspect, larger than ten in another aspect, or larger than twenty in another aspect. This relationship between length L and diameter D of the elongated enclosure 11 can be based on x-ray source 14 size and power, needed air volume, and the size of the area of needed electrostatic dissipation.

One advantage of the arrangement of the x-ray source $\mathbf{13}_a/\mathbf{13}_b$ and associated fluid-flow device $\mathbf{14}_a/\mathbf{14}_b$, respectively, as shown in FIG. 1, is that fluid from the fluid-flow device $\mathbf{14}_a/\mathbf{14}_b$ can cool the x-ray source $\mathbf{13}_a/\mathbf{13}_b$, respectively. Another advantage is that the x-ray source $\mathbf{13}_a/\mathbf{13}_b$ can generate ions along the entire, or substantial portion of, the length L of the elongated enclosure 11. This second advantage is important because after formation of the ions, the ions can recombine. Continued production of ions until they are ready to emit from the elongated enclosure 11 can be important for increasing the number of ions that reach the device needing electrostatic dissipation. Both of these advantages may be lost if the x-ray source 13 emits x-rays perpendicular to the flow of the fluid as shown in FIG. 8. Although the electrostatic dissipation device 80 in FIG. 8 has some disadvantages, this design may be needed in some applications depending on the space available for the x-ray source 13 and fluid-flow device, blocking of x-rays, and also other considerations.

As shown in FIGS. 2*a* & 5, a nozzle 25 can be located at each outlet opening 15. Although not shown in FIGS. 1, 2*b*, 3, 4, and 6, a nozzle 25 can be located at each outlet opening 15 of these embodiments. The nozzle(s) 25 can be used to direct flow of ionized fluid 17 to a specific location, to change the velocity of the ionized fluid 17, to block x-rays 16, or combinations thereof.

Protection of people and sensitive equipment from x-rays 16 can be important. As shown in FIG. 2*a*, the nozzle 25 can include a curved profile so there is no straight-line path from any location inside of the elongated enclosure 11, through the nozzle 25, to outside the elongated enclosure 11. Also, the nozzle 25 can include a material and a thickness to block x-rays. As shown in FIG. 2*b*, if a side wall of the elongated enclosure 11 is thick enough, the outlet opening 15 can include a curved profile so there is no straight-line path from any location inside of the elongated enclosure 11, through an open channel inside the outlet opening 15. Also, the side wall of the elongated enclosure 11 can include a material and a thickness to block x-rays. See blocked x-ray 16 in FIGS. 2*a* & 2*b*. Thus, by proper design of the nozzle(s), the side wall of the elongated enclosure 11, and/or the outlet opening 15, less than 10 microsieverts per hour in one aspect, less than 100 microsieverts per hour in another aspect, or less than 1000 microsieverts per hour in another aspect, of x-rays 16 can pass through the nozzle(s) 25 or the outlet opening 15.

Material and thickness Th of sidewalls of the elongated enclosure 11, and a power of the x-ray source(s) $\mathbf{13}_a$ and $\mathbf{13}_b$, can be selected to block x-rays 16, thus protecting humans and sensitive equipment in the vicinity of the electrostatic dissipation device 10. For example, a thickness Th of sidewalls of the elongated enclosure 11 can be increased and/or materials with high atomic number for the elongated enclosure 11 can be selected. Also, power of the x-ray source can be reduced and material of the x-ray source target can be selected (e.g. silver) for low-energy x-rays, thus making it easier to block the x-rays. Thus, the electrostatic dissipation device 10 can be made so that less than 50 millisieverts per hour in one aspect, less than 5 millisieverts per hour in another aspect, less than 1 millisievert per hour in another aspect, or less than 0.1 millisieverts per hour in another aspect, of x-rays 16 can pass from inside the elongated enclosure 11, to outside of the elongated enclosure 11.

It can be important to design the electrostatic dissipation device 10 to allow laminar flow of the ionized fluid 17, in order to minimize recombination of the ions. One way to do this is to provide a smooth transition into the outlet opening 15(*s*). For example, as shown in FIG. 3, the outlet opening(s) 15 can include a curved entry 35 to allow the ionized fluid 17 to flow from inside the elongated enclosure 11 into the outlet opening 15 along a smooth curvature 35.

Another way to allow laminar flow of the ionized fluid 17 is for an inside of the elongated enclosure 11 to be tubular in shape, such that a cross-section of the elongated enclosure 11 perpendicular to the longitudinal axis 12 has a curved profile, as shown in FIG. 4. This curved profile of the cross-section of the elongated enclosure 11 can include any smoothly-curved shape, including circular or elliptical.

For some applications, x-ray emission in an arc around the elongated enclosure 11 can be useful. Shown in FIG. 4 are a plurality of outlet openings 15 arranged in a 360 degree arc perpendicular to the longitudinal axis 12 of the elongated enclosure 11 and oriented to emit x-rays 16 in a 360 degree arc perpendicular to the longitudinal axis 12 of the elongated enclosure 11. As shown in FIG. 5, a nozzle 25 located at each outlet opening 15 can further assist in directing ionized fluid 17 flow to a specific location, to change the velocity of the ionized fluid 17, and/or to block x-rays 16 from emitting out of the elongated enclosure 11.

As shown in FIG. 6, fins 61 on an inside of the elongated enclosure 11 can improve fluid flow through the elongated enclosure 11 and can direct ionized fluid 17 to the outlet opening(s) 15. The fins 61 can be oriented parallel to the longitudinal axis 12 of the elongated enclosure 11.

X-rays available for formation of ions within the elongated enclosure 11 can be increased if the elongated enclosure 11 fluoresces x-rays. A material at an inside surface of the elongated enclosure 11 can be selected that fluoresces a large amount of x-rays 16 in response to impinging x-rays 16, thus producing a substantial fluoresced x-ray flux. The entire elongated enclosure 11 can be made of this material or this material can coat an inside surface 11, of the elongated enclosure 11. A material (e.g. Ni, Ag) can be selected that has an x-ray emission peak at or near the energy of impinging x-rays. The material (e.g. W) can be selected to both fluoresce x-rays, and to block x-rays from transmitting through the elongated enclosure 11. The material can be selected for high fluorescence of x-rays. For example, fluoresced x-ray flux can be at least 10% of a received x-ray flux in one aspect, at least 30% of a received x-ray flux in another aspect, or at least 50% of a received x-ray flux in another aspect.

Shown in FIGS. 7-8 are electrostatic dissipation devices 70 and 80, which can each include an ionization chamber 72 with a fluid inlet port 72, and outlet opening(s) 15. The ionization chamber 72 and the outlet opening(s) 15 can be similar to or the same as the elongated enclosure 11 described above.

An x-ray source 13 can be attached to the ionization chamber 72 and can emit x-rays 16 into the ionization chamber 72 to ionize a fluid in the ionization chamber 72 to create an ionized fluid 17. The x-ray source 13 can be oriented to emit x-rays 16 inside of and along a longitudinal axis 12 of the ionization chamber 72, as shown in FIG. 7; or the x-ray source 13 can be oriented to emit x-rays 16 perpendicular to a flow of fluid through the ionization chamber 72, as shown in FIG. 8.

A fluid-flow device 14 can cause fluid to flow in the fluid inlet port 72, through the ionization chamber 72, and out the outlet opening(s) 15, to a region 79 with a material having a static charge. The fluid-flow device 14 can be oriented to cause fluid to flow across the x-ray source 13 and parallel to emission of x-rays, as shown in FIG. 7; or the fluid-flow device 14 can be oriented to cause fluid to flow in front of and perpendicular to an x-ray emission end 18 of the x-ray source 13, and perpendicular to emission of x-rays 16, as shown in FIG. 8.

An electrical power supply 71 can be electrically-coupled to the ionization chamber 72 and can energize all or a portion of the ionization chamber 72 to a positive voltage, a negative voltage, or alternating positive and negative voltages. In one embodiment, the electrical power supply 71 can provide to the ionization chamber 72 a single polarity voltage having the same polarity as desired ions in the ionized fluid 17.

In another embodiment, particularly if ions of both polarities are desired for electrostatic dissipation, the electrical power supply 71 can provide to the ionization chamber 72 alternating positive and negative voltage. Each cycle of positive and negative voltage can have a certain duration for optimal flow of ions and minimal recombining of the ions. This duration can depend on fluid flow rate, power of the x-ray source 71, and distance to the region 79. For example, the electrical power supply 71 can be configured to provide the alternating positive and negative voltage with a duration of at least 0.001 second in one aspect, at least 0.01 second in another aspect, at least 0.1 second in another aspect, at least one second in another aspect, or at least 5 seconds in another aspect, at each polarity of voltage before changing to the opposite polarity. The electrical power supply 71 can be configured to provide the alternating positive and negative voltage with a duration of less than 0.01 second in one aspect, less than 0.1 second in another aspect, less than 1 second in another aspect, or less than 10 seconds in another aspect, at each polarity of voltage before changing to the opposite polarity.

Method

A method of electrostatic dissipation of a slab of material 91 (see FIGS. 9-10) can comprise some or all of the following steps, which can be performed in the following order. There may be additional steps not described below. These additional steps may be before, between, or after those described. The slab of material 91 can be dielectric. The slab of material 91 can be a flat panel display, or raw materials being manufactured into a flat panel display. The slab of material 91 can initially be supported by a top side $\mathbf{91}_t$ of a table 92. The table 92 can be dielectric. The table 92 can have a bottom side $\mathbf{91}_b$ opposite the top side $\mathbf{91}_t$. The method can comprise:

1. emitting x-rays 16 into, and forming ions in, a region of fluid adjacent to the bottom side 91*b*, of the dielectric table 92, thus forming a region of ionized fluid 93 (see FIG. 9);
2. lifting the slab of material 91 off of the table 92 using lift pins 94 that extend through holes in the table 92, thus creating a region of low pressure 103 between the slab of material 91 and the table 92 to cause fluid from the region of ionized fluid 93 to flow through gaps 95 around at least a portion of a perimeter of each lift pin 94 because of a pressure differential between the region of ionized fluid 93 and the region of low pressure 103 (see FIG. 10).

What is claimed is:

1. An electrostatic dissipation device comprising:

an elongated enclosure with a longitudinal axis;

a first x-ray source oriented to emit x-rays inside of and along the longitudinal axis of the elongated enclosure;

a second x-ray source oriented to emit x-rays inside of and along the longitudinal axis of the elongated enclosure towards the first x-ray source;

an outlet opening in the elongated enclosure between the first x-ray source and the second x-ray source;

a fluid-flow device oriented to cause fluid to flow: across the first x-ray source; then inside of and along the longitudinal axis of the elongated enclosure, the fluid being ionized by the x-rays, forming ionized fluid; then out of the elongated enclosure through the outlet opening; and a material at an inside surface of the elongated enclosure, that fluoresces x-rays in response to impinging x-rays, producing a fluoresced x-ray flux that is at least 30% of a received x-ray flux.

2. The electrostatic dissipation device of claim 1, further comprising a nozzle at the outlet opening, the nozzle including a curved profile so there is no straight-line path from any location inside of the elongated enclosure, through an open channel inside the nozzle, to outside the elongated enclosure.

3. The electrostatic dissipation device of claim 1, wherein the outlet opening includes a curved profile so there is no straight-line path from any location inside of the elongated enclosure, through the outlet opening, to outside the elongated enclosure.

4. The electrostatic dissipation device of claim 1, further comprising a nozzle at the outlet opening, the nozzle including a shape, a material, and a thickness to allow less than 100 microsieverts per hour of x-rays to pass through the nozzle.

5. The electrostatic dissipation device of claim 1, wherein the outlet opening includes a plurality of outlet openings arranged in a row parallel to the longitudinal axis of the elongated enclosure, and further comprising a plurality of nozzles, each nozzle located in a different one of the plurality of outlet openings.

6. The electrostatic dissipation device of claim 1, wherein a material and a thickness of the elongated enclosure, and a power of the x-ray source, are selected to allow less than 5 millisieverts per hour of x-rays to pass through the elongated enclosure.

7. The electrostatic dissipation device of claim 1, further comprising a second fluid-flow device oriented to cause fluid to flow across the second x-ray source; then inside of and along the longitudinal axis of the elongated enclosure towards the first fluid-flow device, the fluid being ionized by the x-rays, forming ionized fluid; then out of the elongated enclosure through the outlet opening.

8. An electrostatic dissipation device comprising:

an elongated enclosure with a longitudinal axis and an outlet opening;

an x-ray source oriented to emit x-rays inside of and along the longitudinal axis of the elongated enclosure;

a fluid-flow device oriented to cause fluid to flow: across the x-ray source; then inside of and along the longitudinal axis of the elongated enclosure, the fluid being ionized by the x-rays, forming ionized fluid; then out of the elongated enclosure through the outlet opening; and a material, at an inside surface of the elongated enclosure, that fluoresces x-rays in response to impinging x-rays, producing a fluoresced x-ray flux that is at least 30% of a received x-ray flux.

9. The electrostatic dissipation device of claim 8, wherein the outlet opening includes a curved entry to allow the ionized fluid to flow from inside the elongated enclosure into the outlet opening along a smooth curvature.

10. The electrostatic dissipation device of claim 8, further comprising a nozzle at the outlet opening, the nozzle including a shape, a material, and a thickness to allow less than 100 microsieverts per hour of x-rays to pass through the nozzle.

11. The electrostatic dissipation device of claim 8, wherein the outlet opening includes a plurality of outlet openings arranged in a row along the longitudinal axis of the elongated enclosure.

12. The electrostatic dissipation device of claim 8, wherein the outlet opening includes a plurality of outlet openings arranged in a 360 degree arc perpendicular to the longitudinal axis of the elongated enclosure and oriented to emit x-rays in a 360 degree arc perpendicular to the longitudinal axis of the elongated enclosure.

13. The electrostatic dissipation device of claim 8, wherein a material and a thickness of the elongated enclosure, and a power of the x-ray source, are selected to allow less than 5 millisieverts per hour of x-rays to pass through the elongated enclosure.

14. The electrostatic dissipation device of claim 8, wherein a target of the x-ray source comprises silver.

15. The electrostatic dissipation device of claim 8, further comprising an electrical power supply electrically-coupled to the elongated enclosure and capable of energizing at least part of the elongated enclosure to a positive voltage, a negative voltage, or alternating positive and negative voltages.

16. The electrostatic dissipation device of claim 15, wherein the electrical power supply is configured to provide a single polarity voltage having the same polarity as desired ions in the ionized fluid.

17. An electrostatic dissipation device comprising:

an elongated enclosure with a longitudinal axis and an outlet opening;

an x-ray source oriented to emit x-rays inside of and along the longitudinal axis of the elongated enclosure;

a fluid-flow device oriented to cause fluid to flow: across the x-ray source;

then inside of and along the longitudinal axis of the elongated enclosure, the fluid being ionized by the x-rays, forming ionized fluid; then out of the elongated enclosure through the outlet opening; and fins on an inside of the elongated enclosure oriented parallel to the longitudinal axis of the elongated enclosure.

18. The electrostatic dissipation device of claim 17, wherein the outlet opening includes a curved entry to allow the ionized fluid to flow from inside the elongated enclosure into the outlet opening along a smooth curvature.

19. The electrostatic dissipation device of claim 17, further comprising a nozzle at the outlet opening, the nozzle including a shape, a material, and a thickness to allow less than 100 microsieverts per hour of x-rays to pass through the nozzle.

20. The electrostatic dissipation device of claim 17, wherein the outlet opening includes a plurality of outlet openings arranged in a row along the longitudinal axis of the elongated enclosure.

* * * * *